US010443134B2

(12) United States Patent
Brouwer et al.

(10) Patent No.: US 10,443,134 B2
(45) Date of Patent: Oct. 15, 2019

(54) METHOD FOR THE SELECTIVE REMOVAL OF ZINC IONS FROM ALKALINE BATH SOLUTIONS IN THE SERIAL SURFACE TREATMENT OF METAL COMPONENTS

(71) Applicant: Henkel AG & Co. KGaA, Duesseldorf (DE)

(72) Inventors: Jan-Willem Brouwer, Willich (DE); Frank-Oliver Pilarek, Cologne (DE); Jens Kroemer, Neuss (DE); Fernando Jose Resano Artalejo, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 201 days.

(21) Appl. No.: 15/592,520

(22) Filed: May 11, 2017

(65) Prior Publication Data

US 2017/0247799 A1 Aug. 31, 2017

Related U.S. Application Data

(63) Continuation of application No. PCT/EP2015/076282, filed on Nov. 11, 2015.

(30) Foreign Application Priority Data

Nov. 13, 2014 (DE) ..... 10 2014 223 169

(51) Int. Cl.

| | |
|---|---|
| ***C02F 1/42*** | (2006.01) |
| ***C23G 1/14*** | (2006.01) |
| ***C23C 22/60*** | (2006.01) |
| ***C23C 22/77*** | (2006.01) |
| ***C23C 22/78*** | (2006.01) |
| ***C23C 22/86*** | (2006.01) |
| ***C23G 1/36*** | (2006.01) |

(52) U.S. Cl.

CPC ..... *C23G 1/14* (2013.01); *C23C 22/60* (2013.01); *C23C 22/77* (2013.01); *C23C 22/78* (2013.01); *C23C 22/86* (2013.01); *C23G 1/36* (2013.01)

(58) Field of Classification Search

CPC ..... B01J 39/00; B01D 61/00; C23C 22/182

USPC ..... 210/638; 148/262

See application file for complete search history.

(56) References Cited

U.S. PATENT DOCUMENTS

| | | | |
|---|---|---|---|
| 4,002,564 | A | 1/1977 | Carbonel et al. |
| 9,228,088 | B2 | 1/2016 | Brouwer et al. |
| 2004/0054017 | A1 | 3/2004 | Brouwer et al. |
| 2015/0176138 | A1 | 6/2015 | Brouwer et al. |

FOREIGN PATENT DOCUMENTS

| | | | |
|---|---|---|---|
| CN | 103492611 | A | 1/2014 |
| DE | 10056628 | A1 | 5/2002 |
| DE | 10142933 | A1 | 12/2002 |
| DE | 102010001686 | A1 | 8/2011 |
| EP | 1051672 | B1 | 4/2002 |
| WO | 02101115 | A1 | 12/2002 |
| WO | 2014037234 | A1 | 3/2014 |

OTHER PUBLICATIONS

International Search Report for PCT/EP2015/076282, dated Feb. 5, 2016. All references cited in the International Search Report are listed above.

*Primary Examiner* — Gregory E Webb

(74) *Attorney, Agent, or Firm* — Mary K. Cameron

(57) ABSTRACT

The present invention relates to a method for the serial surface treatment of metal components that have zinc surfaces, wherein the method comprises an alkaline pretreatment, and a method for the selective removal of zinc ions from an alkaline bath solution for the serial surface treatment of metal surfaces that have zinc surfaces. According to the invention, in order to perform each method, part of the alkaline aqueous bath solution is brought in contact with an ion exchange resin that bears functional groups selected from $—OPO_3X_{2/n}$ and/or $—PO_3X_{2/n}$, wherein X is either a hydrogen atom or an alkali metal and/or alkaline-earth metal atom to be exchanged having the particular valency n.

19 Claims, No Drawings

METHOD FOR THE SELECTIVE REMOVAL OF ZINC IONS FROM ALKALINE BATH SOLUTIONS IN THE SERIAL SURFACE TREATMENT OF METAL COMPONENTS

The present invention relates to a method for the serial surface treatment of metal components that have zinc surfaces, wherein the method comprises an alkaline pretreatment, and a method for the selective removal of zinc ions from an alkaline bath solution for the serial surface treatment of metal surfaces that have zinc surfaces. According to the invention, in order to perform the particular methods, part of the particular alkaline bath solution is brought in contact with an ion exchange resin that bears functional groups selected from $—OPO_3X_{2/n}$ and/or $—PO_3X_{2/n}$, wherein X is either a hydrogen atom or an alkali metal and/or alkaline-earth metal atom to be exchanged having the particular valency n.

The cleansing and surface conditioning of metal parts before the further processing thereof are standard tasks in the metal-processing industry. The metal parts can be soiled with pigment dirt, dust, metal debris, anti-corrosion oils, cooling lubricants, or forming aids, for example. Before the further processing, for example before a corrosion protection treatment (phosphating, chromating, reaction with complex fluorides, etc.) in particular, these contaminants must be removed by means of a suitable cleansing solution. The cleansing should also ensure that the metal surfaces are preconditioned for the subsequent corrosion protection treatment. The preconditioning is a type of activation of the metal surfaces which, particularly in the case of a subsequent wet-chemical conversion treatment, leads to homogeneous inorganic anti-corrosion coatings having sufficient layer thickness. Such preconditioning or activation is initiated by a pickling process and can also comprise the covering of the metal surfaces with foreign metal elements. A preconditioning known in the prior art that causes an improvement in the corrosion protection properties in the case of subsequent conversion treatment is, for example, the alkaline iron-coating treatment of galvanized steel, which is described in detail in DE 102010001686.

As a wet-chemical pretreatment before a conversion treatment, the industrial cleansers or activation baths, such as in the case of the previously mentioned iron-coating treatment, are generally set so as to be alkaline and have pH values in the range of greater than 7, for example 9 to 12. The basic components thereof are—besides dissolved iron ions—alkalis and complexing agents. The cleansers often contain non-ionic and/or anionic surfactants as additional auxiliary components.

The alkalis in said baths contribute, for example, to the cleansing ability thereof in that said alkalis saponify contaminants such as fats and make said contaminants water-soluble or to the surface activation in that said alkalis pickle the metal surfaces. Alkalinity is consumed by such reactions, and possibly by drag-out, and therefore the cleansing effect is diminished over time in the case of a serial surface treatment of components. Therefore, it is typical that the alkalinity of the cleansing baths is checked at certain times and, if necessary, new active ingredients are added to the solution or the solution is completely replaced. Such a method for refreshing the alkalinity is described in EP 1051672. The case is similar for the iron ions and complexing agents that are consumed or dragged out of the bath in the serial alkaline iron-coating treatment of metal components.

Accordingly, the maintenance of cleansing baths, activation baths, and conversion baths in industrial methods for the serial surface treatment of metal components is indispensable for ensuring consistent functionality and quality. However, in the case of the serial surface treatment of metal components comprising a wet-chemical alkaline pretreatment and a subsequent conversion treatment, it is found that refreshing the content of active components of the individual baths alone is usually not sufficient for sustainably maintaining the functionality and quality of the whole process. In the case of such a serial surface treatment of metal components, it is often found that filiform corrosion on the surfaces of aluminum worsens after a certain operating time of the plant, and countering this worsening of filiform corrosion by adding active components is inadequate.

However, the quality and functionality of a cleansing solution or iron-coating treatment solution can already be reduced by the pickling attack because of the associated rise in the zinc(II) concentration and, if there are aluminum surfaces on the metal components, in the aluminum(III) concentration in solution. Free zinc ions or aluminum ions impair iron deposition and, in particular, subsequent processes such as phosphating and pigmenting and reduce the corrosion resistance of the treated metal surfaces overall.

Therefore, WO 2014/0675234 teaches a maximum concentration of free zinc ions which, in order to ensure the quality of subsequent processes, should not be exceeded. The metered addition of sodium sulfide is described in WO2014/0675234 for the removal of zinc(II) ions from industrial cleansing solutions and iron-coating treatment solutions. Although the addition of such agents can effectively stabilize and regulate the concentration of zinc ions, the use of sulfides to remove zinc ions in the form of zinc sulfide is often undesired because of the odor formation caused by the formation of hydrogen sulfide as a side reaction.

However, the metered addition of complexing agents such as 1-hydroxyethane-1,1-diphosphonic acid (HEDP; CAS no. 2809-21-4) that complex polyvalent metal cations, in particular zinc, iron, and aluminum ions, and thereby accelerate the pickling attack on the surface is only conditionally suitable for overcoming the high content of zinc ions in solution caused by the process. HEDP nonspecifically binds aluminum(III) and iron(III) ions in addition to zinc(II) ions, and therefore the amount of free HEDP that is necessary to keep both zinc and aluminum sufficiently in solution in the form of complexes thereof must be drastically increased, causing both the effectiveness and the economy of the pickling and iron-coating treatment process to suffer.

Therefore, the problem addressed by the present invention is that of stabilizing the alkaline bath solutions used in the previously described methods for serial wet-chemical surface treatment with regard to the effectiveness of said alkaline bath solutions and, for this purpose, offering a method that is as efficient and reliable as possible and that permits the best possible process control of said method. In a specific requirement, the present invention should provide a method for the serial wet-chemical surface treatment of metal components comprising zinc surfaces that is optimized with regard to the effectiveness and quality of the achieved corrosion protection, in which method an iron-coating treatment of the components is used in a first step.

According to the invention, said problem is solved first by means of a method for the selective removal of zinc ions from an alkaline aqueous bath solution for the serial surface treatment of metal components that have surfaces of zinc, which bath solution is stored in a system tank, wherein the alkaline aqueous bath solution contains a) at least 50 mg/kg of iron(III) ions;

b) at least 50 mg/kg of zinc(II) ions; and c) a complexing agent Y in the form of water-soluble condensed phosphates and/or in the form of water-soluble organic compounds that have at least one functional group selected from $—OPO_3X_{2/n}$ and/or $—PO_3X_{2/n}$, wherein X is either a hydrogen atom or an alkali metal and/or alkaline-earth metal atom having the particular valency n; wherein the molar ratio of complexing agent Y, with respect to the element phosphorus, to the total amount of iron(III) ions and zinc(II) ions is greater than 1.0, characterized in that part of the bath solution is brought in contact with an ion exchange resin that bears functional groups selected from $—OPO_3X_{2/n}$ and/or $—PO_3X_{2/n}$, wherein X is either a hydrogen atom or an alkali metal and/or alkaline-earth metal atom to be exchanged having the particular valency n.

In the sense of the present invention, compounds are water soluble if the solubility thereof in deionized water having a conductivity of not more than 1 $\mu Scm^{-1}$ at a temperature of 20° C. is at least 1 g/l.

According to the invention, a serial surface treatment is the bringing of a multiplicity of metal components in contact with the alkaline bath solution stored in the system tank for wet-chemical pretreatment, without a complete exchange with a new preparation of the alkaline bath solution of the system tank occurring after each pretreatment of an individual metal component.

According to the invention, the term "system tank" is understood to mean a container that stores a bath solution for bringing in contact with the metal components. The metal component can be passed through such a system tank while immersed in order to bring the metal component in contact with the bath solution, or at least part of the bath solution can be temporarily fed out of the system tank in order to bring said bath solution in contact with the metal component and then at least partially fed back into the system tank after having been brought in contact, for example after spray application.

Accordingly, the method for the selective removal of zinc ions from an alkaline bath solution containing iron(III) ions and complexing agent Y as active constituents and an amount of zinc ions pickled out of the metal components is based on processing by means of a specific ion exchange resin. Surprisingly, only zinc ions are removed, while the iron(III) ions remain in solution in the bath in the presence of the complexing agent Y.

For said selective removal of the zinc ions, it has been found to be advantageous if the molar ratio of complexing agent Y, with respect to the element phosphorus, to the total amount of iron(III) ions and zinc(II) ions in the bath solution is greater than 1.5, preferably greater than 2.0, so that a molar excess of the functional groups of the complexing agent Y in relation to the iron ions and zinc ions is ensured. On the other hand, a much higher molar ratio in the bath solution is less efficient, because in this case considerably more complexing agent than necessary to keep the iron ions and zinc ions homogeneously in solution at the prevailing alkalinity is used. Rather, the objective is the most economical possible use of the complexing agent Y, which is ensured in the method according to the invention because of the selective removal of the zinc ions by means of the ion exchange resin and the associated regeneration of unbound complexing agent in the bath solution. Therefore, the molar ratio of complexing agent Y, with respect to the element phosphorus, to the total amount of iron(III) ions and zinc(II) ions in the bath solution of the method according to the invention for the selective removal of zinc ions is preferably not greater than 5.0, especially preferably not greater than 4.0, particularly preferably not greater than 3.0.

In a method according to the invention for the selective removal of zinc ions, it is also preferred that the organic complexing agents Y are selected from water-soluble organic compounds that additionally contain, in the α or β position with respect to an $—OPO_3X_{2/n}$ and/or $—PO_3X_{2/n}$ functionality, an amino, hydroxyl, or carboxyl group, preferably a hydroxyl group, especially preferably a hydroxyl group but no amino group, and particularly preferably have at least two such functional groups selected from $—OPO_3X_{2/n}$ and/or $—PO_3X_{2/n}$. An especially preferred representative of an organic complexing agent Y is 1-hydroxyethane-1,1-diphosphonic acid (HEDP).

On the whole, in a method according to the invention for the selective separation of zinc ions, it is preferred that the organic complexing agents Y are not polymeric compounds, the molar mass of the organic complexing agents Y therefore preferably being less than 500 g/mol.

For the most efficient possible removal of zinc ions from the bath solution in the method according to the invention, the ion exchange resin has preferably at least 1.0 mol, especially preferably in total at least 1.5 mol, particularly preferably in total at least 2.0 mol, of the functional groups selected from $—OPO_3X_{2/n}$ and/or $—PO_3X_{2/n}$ per kilogram of the ion exchange resin.

According to the invention, it is also preferred and especially advantageous if the ion exchange resin bears functional groups that bind the zinc ions more strongly than the complexing agents Y contained in the alkaline bath solution do, in particular at least by a factor of 2, preferably by a factor of 10. This enables the ion exchange resin to also remove complexed zinc ions from the bath solution and thus, for example, to regenerate the complexing agent contained in the bath solution.

The functional groups of the ion exchange resin must have a high affinity for zinc ions and, at the same time, a lower affinity for iron(III) ions. The applies in particular to methods according to the invention for the selective removal of zinc ions in which alkaline bath solutions are used in surface treatments for the iron-coating treatment of zinc surfaces. In such alkaline bath solutions, the iron(III) fraction is an active constituent which, in the method according to the invention, should remain in the bath solution as completely as possible and should not be bonded to the ion exchange resin.

It is therefore preferred that the functional groups of the ion exchange resin bind iron(III) ions more weakly than the complexing agents contained in the alkaline bath solution do, in particular at least by a factor of 2, preferably by a factor of 10. This makes it possible to use the ion exchanger specifically to deplete the bath solution of Zn(II) ions without significantly influencing the concentrations of the Fe(III) ions. This is advantageous particularly because the zinc ion concentration can thus be specifically regulated without the iron-coating treatment properties of the solution being significantly influenced.

The binding strength, used as a relative expression in this context, relates in particular to the complex formation constant $K_A$ of the complexing agents for the complexed metal ions. The complex formation constant is the product of the equilibrium constants of the individual elementary reactions for complex formation, i.e., of the individual, successive steps of the ligand binding. Therefore, binding that is stronger by a factor of 2, for example, means that the complex formation constant $K_A$ of the corresponding complexing agent is twice as large as the reference value. Even in the case of complexing agents which, according to the invention, are bonded to a solid substrate, the complex formation constants always relate to the corresponding values of the complexing agent in solution.

Preferred in this context are methods for the selective separation of zinc ions which by using ion exchange resins having such functional groups and additionally having, in the α or β position with respect to an —$OPO_3X_{2/n}$ and/or —$PO_3X_{2/n}$ group, an amino, hydroxyl, or carboxyl group, especially preferably an amino group, particularly preferably an amino group but no hydroxyl group. In an especially preferred embodiment, the functional groups of the ion exchange resin are selected from aminoalkyl phosphonic acid groups, preferably from aminomethyl phosphonic acid groups, especially preferably from the group —$NR^1$—$CH_2$—$PO_3X_{2/n}$, wherein X is either a hydrogen atom or an alkali metal and/or alkaline-earth metal atom to be exchanged having the particular valency n and $R^1$ is a hydrogen atom or an alkyl, cycloalkyl, or aryl residue having preferably not more than 6 carbon atoms.

The matrix of the ion exchange resin can be a known polymer. For example, the matrix can consist of cross-linked polystyrene, such as polystyrene-divinylbenzene resin. In methods according to the invention for the selective separation of zinc ions, a polymer backbone based on the monomers styrene, divinylbenzene, and/or based on phenol-formaldehyde condensates is preferred as the ion exchange resin, and a polymer backbone based on the monomers styrene and/or divinylbenzene is especially preferred as the ion exchange resin.

In an exceedingly preferred embodiment, the ion exchange resin has chelating aminomethyl phosphonic acid groups and a cross-linked polystyrene matrix. Such ion exchange resins are described in detail in U.S. Pat. No. 4,002,564 (column 2, line 12-column 3, line 41) and are preferred in the present invention.

The ion exchange resins used are preferably water-insoluble solids, particularly in particulate form, especially preferably in the form of beads having a preferred bead diameter in the range of 0.2-2 mm, especially preferably in the range of 0.4-1.4 mm. This makes it possible to separate the ion exchange resin from the part of the alkaline bath solution that was brought in contact with the ion exchange resin and is subsequently returned to the system tank, for example by means of filtration or other conventional separating methods, for example by means of a cyclone or a centrifuge. Alternatively, the ion exchange resin can also be provided in a container, through which the part of the alkaline bath solution that is brought in contact with the ion exchange resin and subsequently returned to the system tank flows and which holds back the ion exchange resin.

In the various embodiments of the invention, the ion exchange resin has a resin capacity for dissolved zinc of at least 10 g/l, particularly at least 20 g/l.

It is also preferred that the ion exchange resin laden with zinc ions can be regenerated, i.e., the zinc ions are not irreversibly bound. Regeneration methods are dependent on the resin used and are well known in the prior art. Here, the term "regeneration" refers to the displacement of the zinc ions bonded to the ion exchange resin by displacement ions used in excess, as a result of which displacement the ion exchange resin is available again as a complexation agent for the selective removal of dissolved zinc from the alkaline bath solutions.

In the method according to the invention for the selective removal of zinc ions, the alkaline bath solution can be brought in contact with the ion exchange resin discontinuously or continuously. Either part of the bath solution is brought in contact with the ion exchange resin for a specified time or parts of the bath solution are continuously brought in contact with the ion exchange for a certain time. In the method according to the invention, the bringing in contact preferably occurs continuously, for example by the flow of bath solution through a container holding the ion exchange resin.

Accordingly, a method for the selective removal of zinc ions in which part of the bath solution is brought in contact with the ion exchange resin in a container spatially separated from the system tank and said part of the bath solution is fed back into the system tank discontinuously or continuously, in particular continuously, after being brought into contact with the ion exchange resin is preferred.

For this purpose, the part of the bath solution is preferably fed into the container through inlet openings in order to bring the part of the bath solution in contact with the ion exchange resin and the part of the bath solution is fed out through outlet openings after being brought in contact with the ion exchange resin, wherein the ion exchange resin remains in the container (so-called bypass method).

Selective removal of zinc ions is possible for a wide range of amounts of the iron(III) ions in this method according to the invention. However, the content of iron(III) ions in the bath solution preferably does not exceed 2 g/kg, especially preferably not more than 1 g/kg. On the other hand, for the purpose of adequate iron-coating treatment of the zinc surfaces of the metal components in a corresponding surface treatment, preferably at least 100 mg/kg, especially preferably at least 200 mg/kg, of iron(III) ions should be contained in the alkaline bath solution in a method according to the invention for the selective removal of zinc ions.

Furthermore, it is advantageous in this context—i.e., for adequate iron-coating treatment of the zinc surfaces of the metal components—if zinc ions are selectively removed from bath solutions that have a pH value of at least 9, especially preferably at least 10, wherein the free alkalinity is preferably at least 0.5 points, but preferably less than 50 points.

The free alkalinity of the alkaline bath solution for wet-chemical surface treatment from which zinc ions should be selectively removed in accordance with the invention is determined by the titration of 10 ml of the bath solution with 0.1 N sodium hydroxide solution to a pH value of 8.5. The pH value is determined potentiometrically with a calibrated glass electrode. The volume of the titrant to be added in milliliters then corresponds to the number of points of the free alkalinity of the bath solution. Said number of points multiplied by a factor of 10 corresponds in turn to the free alkalinity in millimoles per liter.

The active components common in the prior art are used to set the alkalinity in the bath solutions of the present invention. Such active components are substances that react in an alkaline manner and are preferably selected from alkali metal hydroxides, alkali metal carbonates, alkali metal phosphates, and organic amines, in particular alkanolamines.

Because the method according to the invention for the selective removal of zinc ions from alkaline bath solutions concerns mainly bath solutions suitable for the surface treatment of metal components, methods in which the alkaline bath solutions contain preferably not more than 0.6 g/kg, especially preferably not more than 0.4 g/kg, of aluminum dissolved in water are preferred, because above these concentrations the surface conditioning achieved by means of the alkaline bath solution, in particular on metal components that additionally have aluminum surfaces, is less effective with regard to the corrosion protection properties of a subsequent conversion coating.

In a second aspect, the present invention relates to a method for the serial wet-chemical surface treatment of metal components comprising zinc and aluminum surfaces, said method being optimized with regard to effectiveness and quality of the achieved corrosion protection, wherein alkaline bath solutions are used for iron-coating treatment and the concentration of zinc ions is kept below a specified threshold value. In said second aspect, the present invention relates to a method for the wet-chemical surface treatment of metal components, which have surfaces of zinc and aluminum or surfaces of zinc in one component and surfaces of aluminum in another component and which are serially wet-chemically pretreated by bringing said components in contact with an alkaline bath solution, which is stored in a system tank and contains a) a complexing agent Y in the form of water-soluble condensed phosphates and/or in the form of water-soluble organic compounds that have at least one functional group selected from —$COOX_{1/n}$, —$OPO_3X_{2/n}$, and/or —$PO_3X_{2/n}$, wherein X is either a hydrogen atom or an alkali metal and/or alkaline-earth metal atom having the particular valency n, wherein the complexing agent is, in particular, HEDP, and b) iron(III) ions, preferably at least 50 mg/kg, especially preferably at least 100 mg/kg, particularly preferably at least 200 mg/kg, of iron(III) ions, but preferably not more than 2 g/kg, especially preferably not more than 1 g/kg, of iron(III) ions, wherein the pH value of the alkaline bath solution in the wet-chemical pretreatment is greater than 10 and the free alkalinity is at least 0.5 points, but less than 50 points, wherein the following maximum value $Zn_{max}$ for the concentration of dissolved zinc in the alkaline bath solution of the system tank is not exceeded:

$$Zn_{max}=0.0004\times(pH-9)\times[FA]+0.6\times[Y],$$

pH: pH value $Zn_{max}$: maximum value for the concentration of dissolved zinc in mmol/l

[FA]: free alkalinity in mmol/l

[Y]: concentration in mmol/l of complexing agents Y in the form of water-soluble condensed phosphates calculated as $P_2O_6$ and/or in the form of water-soluble organic compounds that have at least one functional group selected from —$COOX_{1/n}$, —$OPO_3X_{2/n}$, and/or —$PO_3X_{2/n}$, wherein X is either a hydrogen atom or an alkali metal and/or alkaline-earth metal atom having the particular valency n;

wherein exceedance of the maximum value $Zn_{max}$ in the wet-chemical pretreatment is prevented in that at least part of the alkaline bath solution of the system tank is brought in contact with a zinc-binding ion exchange resin in order to remove dissolved zinc from the part of the alkaline bath solution and the part of the alkaline bath solution that was brought in contact with the zinc-binding ion exchange resin is subsequently returned to the system tank.

According to said second aspect of the present invention, the term "zinc-binding ion exchange resin" is understood to mean the same ion exchange resin that is also used for the method according to the invention for the selective separation of zinc ions from alkaline bath solutions for the surface treatment of metal components that have surfaces of zinc and that was described in accordance with this first aspect of the present invention. Preferred embodiments described there with regard to the ion exchange resin are accordingly also preferred with regard to the second aspect of the present invention.

In a method for surface treatment according to the invention, comprising a pretreatment with an alkaline bath solution and a subsequent conversion treatment, it is ensured that the formation of a high-quality corrosion protection layer is maintained in the serial surface treatment, in which surface treatment components having zinc surfaces and preferably also components having aluminum surfaces and preferably components in mixed design having zinc surfaces and aluminum surfaces are treated. This applies in particular to the maintenance of the quality of the anti-corrosion coating on the surfaces of the component that are surfaces of aluminum. As described in WO2014/0675234, in particular the concentration of dissolved zinc in alkaline bath solutions is critical to this and therefore becomes a control variable to be controlled in the surface treatment according to the invention. If a maximum concentration $Zn_{max}$ of dissolved zinc is exceeded, adequate activation of the aluminum surfaces of the components does not occur in the pretreatment, and this has a disadvantageous effect on the formation of a conversion layer. Surprisingly, it has now been found that, by adding zinc-binding ion exchange resins in a metered manner, dissolved zinc contained in the alkaline bath solutions can be selectively complexed and therefore removed without the removal of active constituents of the pretreatment from the bath solution, which pretreatment should, in particular, bring about an iron-coating treatment of the zinc surfaces.

In a method according to the second aspect of the present invention, considerable pickling removal from the zinc surfaces of the components results, regardless of the exact compositions of the alkaline bath solution of the wet-chemical pretreatment. Because of said pickling removal in the serial surface treatment according to the invention, a high static fraction of dissolved zinc is present or built up in the system tank of the wet-chemical pretreatment.

Therefore, according to the invention, technical measures for removing or reducing the fraction of dissolved zinc in the bath solution of the system tank are taken in the process control in order to sustainably ensure optimal corrosion protection after conversion treatment has occurred. Specifically, the dissolved zinc is removed or the concentration thereof is reduced by bringing at least part of the alkaline bath solution in contact with a zinc-binding ion exchange resin. This removal can occur continuously or discontinuously, wherein continuous removal is preferred. According to the method according to the invention, the dissolved zinc is not removed exclusively by disposing of part of the alkaline bath solution of the system tank and adding another part of the alkaline bath solution containing only the active components of the alkaline bath solution to the system tank.

In this context, the term "active components" is understood to mean only components that are essential for setting the alkalinity of the bath solutions or that bring about a significant surface coating of the treated components with foreign elements or chemical compounds and are thus consumed. A significant surface coating is present, for example, if the fraction of foreign elements on the metal surfaces or the fraction of chemical compounds is greater than 10 mg/$m^2$ on average. For example, this is the case if, as in the alkaline iron-coating treatment according to DE 102010001686, a surface coating above 10 mg/$m^2$ with respect to the foreign element of iron results after wet-chemical pretreatment has occurred, iron(III) ions therefore being an active constituent in such an alkaline pretreatment. The case can be similar for corrosion inhibitors which have a high affinity for the metal surfaces to be treated and which can therefore cause a corresponding surface coating.

Accordingly, the removal of dissolved zinc from the alkaline bath solution in order to adhere to the maximum value $Zn_{max}$ is preferably not accomplished solely by the compensation of drag-out losses or evaporative losses in the system tank by adding aqueous solutions that replace only the active components of the alkaline bath solution of the system tank and bath volume. Such a method for reducing the fractions of dissolved zinc would be extremely costly and would not be suitable for effectively controlling the fraction of dissolved zinc in the pretreatment, because either the reduction of the zinc fraction to below the maximum value $Zn_{max}$ or the replenishment of the active components precisely as needed would have to be prioritized in the process control. According to the invention, it is also preferable to forgo the use of sulfides to remove dissolved zinc by precipitation as zinc sulfide. Therefore, sodium sulfide is preferably not used to precipitate dissolved zinc in the methods according to the invention.

With regard to the serial surface treatment, it is preferred in a method according to the second aspect of the present invention that the serial wet-chemical surface treatment of the metal components occurs at least for such a quantity of metal components that a total area of only zinc surfaces of the metal components in square meters that is greater than the following term is wet-chemically pretreated with the alkaline bath solution of the system tank:

$$\frac{V_B \times Zn_{max} \times M_{Zn}}{\Delta m_{Zn}}$$

$V_B$: bath volume in $m^3$ $Zn_{max}$: maximum concentration of dissolved zinc in mmol/l $M_{Zn}$: molar mass of zinc in g/mol $\Delta m_{Zn}$: area-standardized pickling removal with respect to the zinc surfaces of the metal components in $g/m^2$ Said quantity corresponds precisely to the theoretically required quantity of metal components capable of causing the maximum concentration $Zn_{max}$ of dissolved zinc in the alkaline bath solution to be exceeded by the pickling removal from the zinc surfaces of the components in serial pretreatment.

Thus, if the bath volume of the system tank containing the alkaline bath solution is completely exchanged and therefore the series is interrupted before the total area of zinc surfaces calculated in accordance with the previously stated equation has been treated, the maximum concentration $Zn_{max}$ of dissolved zinc in the alkaline bath solution cannot be exceeded solely as a result of pickling processes. Of course, this applies only if dissolved zinc is not already contained in the alkaline bath solution at the start of the series.

The method according to the invention for wet-chemical surface treatment is preferably performed in such a way that the maximum value $Zn_{max}$ of dissolved zinc in the alkaline bath solution does not exceed the following value:

$$Zn_{max}=0.0004\times(pH-9)-[FA]+0.5\times[Y]$$

pH: pH value $Zn_{max}$: maximum value for the concentration of dissolved zinc in mmol/l

[FA]: free alkalinity in mmol/l

[Y]: concentration in mmol/l of complexing agents Y in the form of water-soluble condensed phosphates calculated as $P_2O_6$ and/or in the form of water-soluble organic compounds that have at least one functional group selected from $—COOX_{1/n}$, $—OPO_3X_{2/n}$, and/or $—PO_3X_{2/n}$, wherein X is either a hydrogen atom or an alkali metal and/or alkaline-earth metal atom having the particular valency n.

In methods according to the invention for wet-chemical surface treatment, the maximum value $Zn_{max}$ of dissolved zinc depends on the alkalinity of the wet-chemical pretreatment and especially on the concentration of specific complexing agents Y. In the presence of said complexing agents Y, the tolerance to dissolved zinc increases in proportion to the concentration of said complexing agents Y. Therefore, the presence of complexing agents Y is preferred in alkaline bath solutions of the pretreatment in methods according to the invention. The complexing agents Y are especially preferably contained in a total concentration of at least 0.5 mmol/l, particularly preferably in a total concentration of at least 5 mmol/l, but for economic reasons in a total concentration of preferably not more than 100 mmol/l, especially preferably not more than 80 mmol/l.

It has been found that, in particular, organic complexing agents Y selected from water-soluble organic compounds that have at least one functional group selected from $—OPO_3X_{2/n}$ and/or $—PO_3X_{2/n}$, wherein X is either a hydrogen atom or an alkali metal and/or alkaline-earth metal atom having the particular valency n, ensure a stable maximum concentration $Zn_{max}$ as an upper limit for dissolved zinc. Therefore, said organic complexing agents are preferred in methods according to the invention. Furthermore, for selective removal of zinc ions by means of zinc-binding ion exchange resin, in the case of which removal iron(III) ions remain in solution, it is preferred that the organic complexing agents Y in the method for surface treatment are selected from water-soluble organic compounds that additionally contain, in the α or β position with respect to an $—OPO_3X_{2/n}$ and/or $—PO_3X_{2/n}$ functionality, an amino, hydroxyl, or carboxyl group, preferably a hydroxyl group, and especially preferably a hydroxyl group but no amino group, and particularly preferably have at least two such functional groups selected from $—OPO_3X_{2/n}$ and/or $—PO_3X_{2/n}$. An especially preferred representative of an organic complexing agent Y is 1-hydroxyethane-1,1-diphosphonic acid (HEDP).

In general, it is preferred that the organic complexing agents Y are not polymeric compounds, the molar mass of the organic complexing agents Y preferably being less than 500 g/mol.

In an especially preferred method according to the invention for serial wet-chemical surface treatment, the alkaline bath solution contains:

a) 0.05-2 g/l of iron(III) ions, b) 0.1-4 g/l of phosphate ions, c) at least 0.1 g/l of complexing agents Y selected from organic compounds that have at least one functional group selected from $—OPO_3X_{2/n}$ and/or $—PO_3X_{2/n}$, wherein X is either a hydrogen atom or an alkali metal and/or alkaline-earth metal atom having the particular valency n, d) 0.01-10 g/l, in total, of non-ionic surfactants, e) less than 10 mg/l, in total, of ionic compounds of the metals nickel, cobalt, manganese, molybdenum, chromium, and/or cerium, in particular less than 1 mg/l of ionic compounds of the metals nickel and/or cobalt, wherein not more than 10 g/l of condensed phosphates calculated as $PO_4$ are contained and the molar ratio of the complexing agents Y, with respect to the element phosphorus, to the total amount of iron(III) ions and zinc(II) ions is greater than 1.0, preferably greater than 1.5, especially preferably greater than 2.0.

In an especially preferred method according to the invention, dissolved zinc is continuously removed from the alkaline bath solution of the wet-chemical pretreatment in that partial volumes of the alkaline bath solution are continuously removed from the system tank and are brought in contact with the zinc-binding ion exchange resins, whereupon the accordingly treated partial volumes of the alkaline bath solution are separated from the ion exchange resin and subsequently returned to the system tank. A method in which partial volumes are removed from the system tank, processed, and subsequently returned to the system tank is generally also referred to as a bypass method in the prior art.

In the case of a serial surface treatment of metal components according to the invention in which components having aluminum surfaces are also treated, an elevated fraction of dissolved aluminum can also build up in the alkaline bath solutions of the wet-chemical pretreatment because of pickling processes. An elevated fraction of dissolved aluminum can, in turn, have a negative effect on the activation of the aluminum surfaces, as a result of which reduced corrosion protection after conversion treatment is observed. In methods according to the invention, slight worsening of the corrosion protection properties is observed above an aluminum fraction of 0.4 g/L, while this worsening becomes significant above 0.6 g/L.

In a preferred embodiment of the surface treatment according to the invention, the alkaline bath solutions of the wet-chemical pretreatment therefore contain aluminum dissolved in water, wherein however a maximum value of 0.6 g/l, preferably 0.4 g/l, for the concentration of dissolved aluminum in the alkaline bath solution is not exceeded because at least part of the alkaline bath solution of the system tank is mixed with a water-soluble compound that is a source of silicate anions and a precipitate forming in said part of the alkaline bath solution is separated from the alkaline bath solution, preferably by filtration.

In an especially preferred method according to the invention, the fraction of dissolved aluminum in the alkaline bath solution of the wet-chemical pretreatment is reduced in that the partial volumes are continuously removed from the bath solution of the system tank and mixed with the water-soluble compound that is a source of silicate anions, whereupon the solid fraction arising in said partial volumes of the alkaline bath solution is separated from the alkaline bath solution, preferably by filtration, and then the partial volumes of the alkaline bath solution that have been freed of the solid are returned to the system tank, preferably as a filtrate.

In such a preferred bypass method, the metered addition of the water-soluble compounds that are a source of silicate anions can occur independently of the bringing in contact with the zinc-binding ion exchange resin. In this way, the fractions of dissolved zinc and aluminum in the system tank can be controlled independently of each other. Therefore, in an especially preferred bypass method, the partial volumes of the alkaline bath solution that are removed from the system tank are first mixed with appropriate amounts of these precipitation reagents and the solid fraction consisting largely of aluminum silicate is separated from the bath solution, preferably by filtration, and then, preferably as a filtrate, the partial volumes of the alkaline bath solution that have been freed of said solid fraction are brought in contact with the zinc-binding ion exchange resin and finally returned to the system tank. Alternatively, but less preferably, the removal of the dissolved zinc by means of the zinc-binding ion exchange resin occurs first and then the precipitation of the aluminum occurs.

Preferably alkali metal silicates and alkaline-earth metal silicates and/or silicic acid are used as water-soluble compounds that are a source of silicate anions and that are therefore a precipitation reagent for dissolved aluminum.

The filtration in the previously mentioned preferred embodiments of the method for surface treatment according to the invention occurs preferably with an exclusion limit of 0.5 μm, especially preferably with an exclusion limit of 0.1 μm.

The fractions of dissolved zinc and aluminum in the alkaline bath solution of the wet-chemical pretreatment are preferably analytically determined simultaneously with the process, i.e., during the serial surface treatment of the metal components according to the invention, and are used directly or indirectly as control variables for technical measures for reducing the fraction of dissolved zinc and/or aluminum in the system tank. For this purpose, preferably a volumetric flow is removed from the system tank and filtered, preferably with an exclusion limit of 0.1 μm, and, before the filtrate is fed back into the system tank, a sample volume is removed and the fraction of dissolved zinc and aluminum is determined, preferably photometrically, wherein the determined value for the dissolved fractions is then compared with the previously stated preferred maximum values for dissolved aluminum and with the maximum value $Zn_{max}$. After the sampling from the alkaline bath solution, the fraction of dissolved zinc and/or aluminum can decrease further as a result of post-precipitation of poorly soluble hydroxides. It is therefore preferred for the determination of the actual concentration—thus the concentration according to the invention—of dissolved zinc and aluminum that, directly after the sample has been removed, i.e. within 5 minutes, the sample is first filtered by means of a filter with an exclusion limit of 0.5 μm, especially preferably 0.1 μm, and then is acidified, preferably to a pH value of less than 3.0. Samples prepared in such a way can be analytically measured at any later time, because the fraction of dissolved zinc or aluminum in the acidic sample volume does not change. For every determination method for dissolved zinc and aluminum, the determination method must be calibrated with standard solutions of primary standards. A photometric determination of the fractions of dissolved zinc and aluminum can be performed in the same sample volume or in parts of the removed sample volume that are separated from each other. Determination by means of inductively coupled argon plasma optical emission spectroscopy (ICP-OES) is preferred.

In the method for surface treatment according to the invention, the wet-chemical pretreatment with the alkaline bath solution is preferably followed by a conversion treatment of the metal components. According to the invention, the conversion treatment is preferably a wet-chemical electroless pretreatment in the course of which an inorganic coating is produced on the aluminum surfaces of the metal components, which is constructed at least partially of elements of the treatment solution that are not only oxygen atoms. Conversion treatments are well known in the prior art and have been described many times, for example as phosphating, chromating, and chromium-free alternative methods, for example on the basis of complex metal fluorides.

The method for surface treatment according to the invention is particularly advantageous if the conversion treatment following the wet-chemical pretreatment with the alkaline bath solution is performed with an acidic aqueous composition containing water-soluble compounds of the elements Zr, Ti, and/or Si. In this context, acidic aqueous compositions that additionally contain compounds that are a source of fluoride ions are preferred. The water-soluble compounds of the elements Zr, Ti, and/or Si are preferably selected from hexafluoro acids of said elements and salts thereof, while compounds that are a source of fluoride ions are preferably selected from alkali metal fluorides. The total fraction of water-soluble compounds of the elements Zr, Ti, and/or Si in the acidic aqueous composition of the conversion treatment of the surface treatment according to the invention is preferably at least 5 ppm, particularly preferably at least 10 ppm, but the acidic composition contains preferably not more than 1000 ppm of said compounds in total, with respect to the previously mentioned elements. The pH value of the acidic aqueous composition preferably lies in a range of 2-4.5.

The method according to the invention is especially suitable for the serial surface treatment of metal components produced in mixed design, because, for such components, an anti-corrosion coating largely homogeneous over the entire component for minimizing contact corrosion can be sustainably achieved by means of the serial surface treatment according to the invention. The method for serial surface treatment according to the invention is effective particularly for metal components in mixed design having surfaces consisting of at least 2%, preferably at least 5%, of surfaces of aluminum and at least 5%, preferably at least 10%, of surfaces of zinc. The percentage of the surfaces of aluminum and zinc always relates to the total surface of the metal component that is brought in contact with the alkaline bath solution of the wet-chemical pretreatment.

In the context of the present invention, metal surfaces of alloys of zinc and aluminum are also considered to be surfaces of zinc and aluminum, provided that the fraction of the elements added as alloying elements lies below 50 at.%. Furthermore, in the sense of the present invention, surfaces of zinc are also formed by galvanized or alloy galvanized steel elements, which are assembled alone or with other metal parts to form the metal component.

EXAMPLES

An alkaline iron-coating treatment solution was prepared and sent across columns having different ion exchange resins in parallel. The specific load per column was 5 BV/h (20° C.), wherein the resin volume was 0.1 l at a layer height of 30 cm.

The iron-coating treatment solution was composed as follows:

free alkalinity (FA): 16 points;

bound alkalinity: 46 points;

pH value: 11.7;

Fe(III) ion concentration: 0.35 g/l;

Zn(II) ion concentration: 1.0 g/l;

HEDP: 12.0 g/l;

$P_2O_7$: 1.5 g/l;

$PO_4$: 3.0 g/l;

The separating performance of different ion exchange resins was examined and is presented in Table 1. To determine the separating performance, the concentration of the elements zinc and iron was examined in effluent samples of the iron-coating treatment solution during a throughput of 10 BV (bed volumes) of the iron-coating treatment solution at 20° C. by means of ICP-OES.

TABLE 1

| Ion Exchange Resins | | | |
|---|---|---|---|
| | A | B | C |
| Functional group | —NH—$CH_2$—$PO_3H_2$ | —NH—C(═S)—$NH_2$ | Polyamines |
| Number density* [eq./l] | 1.15 | 1.0 | 1.15 |
| Matrix | Polystyrene | Polystyrene | Acrylate-divinylbenzene copolymer |
| Particle size [mm] | 0.55 | 0.55 | 0.7 |
| Selectivity[1] | ⊕⊕ | Ø | ⊙ |
| Zn load[2] [g/l] | 20-25 | <1 | 2 |

*with respect to the particular functional group in the dry resin material

[1]determined after the throughput of 2 BV and determined as the quotient ΔZn/ΔFe from the concentration difference of the elements Zn and Fe ⊕⊕more than 1000

⊕between 100 and 1000

⊙between 5 and 100

Øless than 5

[2]determined after 10 BV and with respect to the dry resin material

What is claimed is:

1. A method for the selective removal of zinc ions from an alkaline aqueous bath solution for the serial surface treatment of metal components that have surfaces of zinc, said alkaline aqueous bath solution being stored in a system tank, wherein the alkaline aqueous bath solution contains:

a) at least 50 mg/kg of iron(III) ions;

b) at least 50 mg/kg of zinc(II) ions; and c) a complexing agent Y in the form of water-soluble condensed phosphates; water-soluble organic compounds that have at least one functional group selected from —$OPO_3X_{2/n}$, —$PO_3X_{2/n}$, and combinations thereof, wherein X is either a hydrogen atom or an alkali metal and/or alkaline-earth metal atom having a particular valency n; and combinations thereof;

wherein the alkaline aqueous bath solution has a molar ratio of the complexing agent Y, with respect to the element phosphorus, to a total amount of the iron(III) ions and the zinc(II) ions that is greater than 1.0;

the method comprising steps of:

contacting a part of the bath solution with an ion exchange resin that bears functional groups containing —$OPO_3X_{2/n}$ and/or —$PO_3X_{2/n}$, wherein X is either a hydrogen atom or an alkali metal and/or alkaline-earth metal atom to be exchanged having a particular valency n.

2. The method according to claim 1, wherein the alkaline aqueous bath solution has a molar ratio of the complexing agent Y, with respect to the element phosphorus, to the iron(III) ions that is greater than 1.5.

3. The method according to claim 1, wherein the iron(III) ions in the alkaline aqueous bath solution are present in an amount of at least 100 mg/kg, but not more than 2 g/kg.

4. The method according to claim 1, wherein the alkaline aqueous bath solution has a pH value that is at least 9 and a free alkalinity that is at least 0.5 points but less than 50 points.

5. The method according to claim 1, wherein the alkaline aqueous bath solution contains not more than 0.6 g/kg of aluminum dissolved in water.

6. The method according to claim 1, wherein the ion exchange resin has, in total, at least 1.0 mol of the functional groups selected from $—OPO_3X_{2/n}$ and/or $—PO_3X_{2/n}$ per kilogram of the ion exchange resin.

7. The method according to claim 1, wherein the ion exchange resin has a polymer backbone based on the monomers styrene, divinylbenzene and/or based on phenol-formaldehyde condensates.

8. The method according to claim 1, wherein the functional groups of the ion exchange resin are selected from aminoalkyl phosphonic acid groups.

9. The method according to claim 8, wherein the aminoalkyl phosphonic acid groups are selected from aminomethyl phosphonic acid groups conforming to $—NR^1—CH_2—PO_3X_{2/n}$, wherein X is either a hydrogen atom or an alkali metal and/or alkaline-earth metal atom to be exchanged having the particular valency n and $R^1$ is a hydrogen atom or an alkyl, cycloalkyl, or aryl residue.

10. The method according to claim 1, wherein the complexing agent Y of the alkaline aqueous bath solution additionally contains, in the α or β position with respect, to an $—OPO_3X_{2/n}$ and/or $—PO_3X_{2/n}$ group, an amino, hydroxyl, or carboxyl group.

11. The method according to claim 1, wherein the ion exchange resin is a solid, which is in the form of beads having a bead diameter in the range of 0.2-2 mm.

12. A method for wet-chemical surface treatment of metal components, which have surfaces of zinc and aluminum and which are serially wet-chemically pretreated comprising steps of:

A.) contacting metal components having surfaces of zinc and aluminum with an alkaline bath solution, which is stored in a system tank and contains:

a) a complexing agent Y in the form of water-soluble condensed phosphates and/or in the form of water-soluble organic compounds, which have at least one functional group selected from $—OPO_3X_{2/n}$ and/or $—PO_3X_{2/n}$, wherein X is either a hydrogen atom or an alkali metal and/or alkaline-earth metal atom having the particular valency n, and b) iron(III) ions, wherein the alkaline bath solution in the wet-chemical pretreatment has a pH value that is greater than 10 and a free alkalinity that is at least 0.5 points, but less than 50 points;

wherein a maximum value "$Zn_{max}$" for concentration of dissolved zinc in the alkaline bath solution of the system tank is not greater than $Zn_{max}$ according to Formula I:

$$Zn_{max}=0.0004\times(pH-9)\times[FA]+0.6\times[Y] \quad (I)$$

pH is pH value;

$Zn_{max}$ is the maximum value for concentration of dissolved zinc in mmol/l;

[FA] is free alkalinity in mmol/l;

[Y] is concentration in mmol/l of complexing agents Y in the form of water-soluble condensed phosphates, calculated as $P_2O_6$, and/or in the form of water-soluble organic compounds that have at least one functional group selected from $—COOX_{1/n}$, $—OPO_3X_{2/n}$, and/or $—PO_3X_{2/n}$, wherein X is either a hydrogen atom or an alkali metal and/or alkaline-earth metal atom having the particular valency n;

and

B.) preventing the maximum value $Zn_{max}$ in the wet-chemical pretreatment from being exceeded by:

1) contacting at least part of the alkaline bath solution of the system tank with an ion exchange resin that bears functional groups containing $—OPO_3X_{2/n}$, and/or $—PO_3X_{2/n}$, wherein X is either a hydrogen atom or an alkali metal and/or alkaline-earth metal atom to be exchanged having the particular valency n, and 2) returning the part of the alkaline bath solution that was brought in contact with the ion exchange resin to the system tank.

13. The method according to claim 12, wherein the iron(III) ions in the alkaline aqueous bath solution are present in an amount of at least 50 mg/kg, but not more than 2 g/kg.

14. The method according to claim 12, wherein the serial wet-chemical surface treatment of the metal components occurs at least for such a quantity of metal components that a total area of only zinc surfaces of the metal components in square meters that is greater than the following term is wet-chemically pretreated with the alkaline bath solution of the system tank:

$$\frac{V_B \times Zn_{max} \times M_{Zn}}{\Delta m_{Zn}}$$

wherein:

$V_B$ is bath volume in $m^3$;

$Zn_{max}$ is maximum concentration of dissolved zinc in mmol/l $M_{Zn}$ is molar mass of zinc in g/mol $\Delta m_{Zn}$ is area-standardized pickling removal with respect to the zinc surfaces of the metal components in $g/m^2$.

15. The method according to claim 12, wherein the alkaline aqueous bath solution contains not more than 0.6 g/kg of aluminum dissolved in water.

16. The method according to claim 12, wherein the ion exchange resin has, in total, at least 1.0 mol of the functional groups selected from $—OPO_3X_{2/n}$ and/or $—PO_3X_{2/n}$ per kilogram of the ion exchange resin.

17. The method according to claim 12, wherein the ion exchange resin has a polymer backbone based on the monomers styrene, divinylbenzene and/or based on phenol-formaldehyde condensates.

18. The method according to claim 12, wherein the functional groups of the ion exchange resin are aminomethyl phosphonic acid groups conforming to $—NR^1—CH_2—PO_3X_{2/n}$, wherein X is either a hydrogen atom or an alkali metal and/or alkaline-earth metal atom to be exchanged having the particular valency n and $R^1$ is a hydrogen atom or an alkyl, cycloalkyl, or aryl residue.

19. The method according to claim 12, wherein the complexing agent Y of the alkaline aqueous bath solution additionally contains, in the α or β position with respect to an —$OPO_3X_{2/n}$ and/or —$PO_3X_{2/n}$ group, an amino, hydroxyl, or carboxyl group, preferably a hydroxyl group, especially preferably a hydroxyl group but no amino group.

* * * * *